US005138858A

United States Patent [19]

Johnson et al.

[11] Patent Number: 5,138,858

[45] Date of Patent: Aug. 18, 1992

[54] METHOD FOR NECKING A METAL CONTAINER BODY

[75] Inventors: Dean Johnson, Littleton; William J. Thomas, Thornton, both of Colo.

[73] Assignee: Ball Corporation, Muncie, Ill.

[21] Appl. No.: 723,957

[22] Filed: Jul. 1, 1991

[51] Int. Cl.[5] ..... B21D 41/04

[52] U.S. Cl. ..... 72/68; 72/84; 72/379.4

[58] Field of Search ..... 72/68, 84, 379.4; 413/69

[56] References Cited

U.S. PATENT DOCUMENTS

| | | | |
|---|---|---|---|
| 3,688,538 | 9/1972 | Hoyne | 72/94 |
| 4,070,888 | 1/1978 | Gombas | 72/91 |
| 4,173,883 | 11/1979 | Boik | 72/354 |
| 4,403,493 | 9/1983 | Atkinson | 72/356 |
| 4,457,158 | 7/1984 | Miller et al. | 72/354 |
| 4,512,172 | 4/1985 | Abbott et al. | 72/68 |
| 4,519,232 | 5/1985 | Traczyk et al. | 72/133 |
| 4,563,887 | 1/1986 | Bressan et al. | 72/84 |
| 4,578,007 | 3/1986 | Diekhoff | 413/6 |
| 4,693,108 | 9/1987 | Traczyk et al. | 72/370 |
| 4,732,027 | 3/1988 | Tracyk et al. | 72/133 |
| 4,781,047 | 11/1988 | Bressan et al. | 72/84 |

*Primary Examiner*—Lowell A. Larson
*Attorney, Agent, or Firm*—Gilbert E. Alberding

[57] ABSTRACT

The present invention is directed to a novel processing for necking metal container bodies. The process comprises die-necking a container body to a first necked plug diameter, employing one or more operations, and thereafter spin-flow necking the container body to a second reduced plug diameter. The utilization of die-necking advantageously reduces plug diameter variability, thereby enhancing and complimenting the spin-flow necking operation.

10 Claims, 2 Drawing Sheets

METHOD FOR NECKING A METAL CONTAINER BODY

FIELD OF THE INVENTION

The present invention relates to necking metal container bodies, and more particularly, to a novel necking method which both reduces process steps by utilizing a spin-flow necking step and reduces attendant production limitations and container variability by die-necking prior to spin-flow necking.

BACKGROUND OF THE INVENTION

Necking metal containers prior to end-piece connection has become widespread, particularly in the beverage industry. By reducing the diameter at an end of a container the amount of end piece material can be decreased to lower packaging costs, and containers can be stacked more readily (i.e., the reduced top of one container can fit within the larger diameter bottom of another), to accommodate storage, handling and display.

Numerous well-known necking techniques have been developed. Such techniques generally entail the use of external dies and/or rollers which act upon the outside of a container body. As used herein, a "die-necking" operation is one operation wherein a cylindrical container body and inward reducing die are axially aligned and opposingly advanced to force an open end of the container body through the reducing die. Due to the high compressive forces imparted to container bodies in die-necking operations, only a relatively small reduction in diameter per operation can be achieved without sidewall buckling or crumpling. As such, several successive die-necking operations are often necessary to achieve a desired reduced diameter.

In necking processes utilizing external rollers, one or more rollers contact the sidewall of a rotating container body near an open end thereof and are driven radially inward. A cylindrical member is internally and rotatably disposed at the open end of the container body to hold the open end during such processes. In most known processes, no internal support is provided in opposing relation to the inward progression of a forming roller, thereby resulting in process control problems which, in practice, limit the degree of inward necking. Further, in such known roll-forming processes, the configuration and relative positioning of the external roller and interfacing external/internal holders cause the open-end of the container body to be drawn through an extremely sharp radius therebetween (i.e., approaching a 90° bend) to form a flange and generate a risk that metal slivers will be created within the container body. Such contemporaneous flange forming and production risk also limit, in practice, the degree of realizable inward necking.

Recently, a novel necking technique, known as "spin-flow necking" and described in U.S. Pat. Nos. 4,563,887 and 4,781,047, has been developed in which two internal members are provided to support and thereby control a rotating container body as an opposing external roller progresses inwardly and axially to neck the container, thereby allowing for a significant increase to the degree of inward necking that, in practice, can be realized in a single process step. More particularly, a first internal support member is configured and disposed in the open end of a container body in opposing relation to a radially driven external roller that is configured and disposed such that an angled first face thereof cams radially inward and axially towards the open end against a complimentarily angled face of the first support member to support and controllably reduce the container body diameter therebetween. Further, a second internal support member is configured and disposed adjacent to and outward from the first support member and relative to the configured external roller to rotatably hold the container body, and more importantly, such that a second angled face of the external roller cooperates with a complimentarily angled face of the second internal member during necking operations to support and thereby control the container body. The external roller is spring-loaded for measured axial movement towards the open end of the container as it cams against the first support member, and the second support member is spring-loaded for measured axial movement away from the first support member in response to the radial and axial movement of the external forming roller.

While spin-flow necking can effectively reduce the number of process steps necessary to achieve a desired neck diameter, and thereby reduce overall equipment requirements and production costs, it is sensitive to plug diameter variations. That is, it has been found that variations in the plug diameters of container bodies produced by different container body makers can, if not properly addressed, cause production problems during spin-flow necking (e.g., container body buckling, crumpling and wrinkling), and otherwise cause undesirable container variability upon completion of spin-flow necking (e.g., variations in container body height and variations in the configuration of the open-end edges of container bodies). In the later regard, and as will be appreciated by those skilled in the art, such container variability can present an impediment to the reduction of end-piece metal requirements.

SUMMARY OF THE INVENTION

Accordingly, primary objects of the present invention are to provide a necking method wherein the process advantages of spin-flow necking are realized while reducing the likelihood of production problems attendant to spin-flow necking, and enhancing container uniformity achieved upon completion of the spin-flow necking portion of the process.

These objectives and additional advantages are realized in the present invention through combinative use of die-necking and spin-flow necking operations. More particularly, by die-necking prior to spin-flow necking in the present invention, plug diameter variations in container bodies are substantially reduced prior to spin-flow necking, thereby reducing the likelihood of container body failure during spin-flow necking operations and increasing container uniformity upon spin-flow necking. Further, it has been found that the present invention increases the tolerance of exterior coatings to spin-flow necking.

The process of the present invention entails performing at least one die-necking operation on the open end of a metal container body to reduce the plug diameter of the open end to a first necked diameter. Each die-necking operation includes axially aligning the open end of the container body with a die-set having an external necking die and opposing internal pilot, and forcing the open end of the container body between the external necking die and internal pilot.

The process of the present invention further includes an adapted spin-flow necking operation on the open end of the container body that has been die-necked to further reduce the plug diameter thereof to a second necked diameter. The spin-flow necking operation includes positioning first and second rotatable support members inside of a container body and an external roller outside of the container body in opposing relation to the first support member. The external container body is then rotatably driven and the external roller is advanced radially inward, wherein an angled first face of the roller cams against a complementarily angled face of the first support member. Similarly, an angled second face of the forming roller cooperates with a complementarily angled face of the second support member.

In one aspect of the invention, the first support member is axially fixed and the external roller is spring-loaded, wherein the external roller will work axially against such spring pressure towards the open end of the container body as it cams against the first support member. Further, the second support member is spring-loaded, wherein the second support member will work axially against such spring pressure towards the open end of the container body as the external roller interfaces therewith during the spin-flow necking operation.

In another aspect of the invention, the diameter of a cylindrical peripheral portion of the second support member, adjacent to said angled face thereof, is adapted to be substantially equal to the first necked diameter of the open end of the container body achieved by the die-necking operation(s), wherein the second support member can be readily positioned within the container body, in a substantially, circumferentially flush manner, for the spin-flow necking operation. Relatedly, a peripheral portion of the first support member, adjacent to said angled face thereof, is configured and disposed to be substantially flush, during spin-flow necking, with that portion of the container body that is inwardly adjacent to the container body portion being spin-flow necked. Such attributes allow for full realization of the control benefits of the spin-flow necking step.

Additionally, in another aspect of the present invention, the inward forming surface of the external necking die used in the die-necking operation and the angled face of the first support member used in the spin-flow necking operation are disposed so that at least a portion of the angled face of the first member is positionable during spin-flow necking substantially flush with the inwardly angled portion of the container body formed during the die-necking operation, thereby enhancing control. Further, since the first angled face of the external roller and the angled face of the first support member are complimentary, necking of the container body during spin-flow necking can be smoothly initiated over or substantially adjacent to said inwardly angled portion of the container body during the die-necking operation preceding spin-flow necking.

In a related aspect of the present invention, the external roller can be positioned at the outset of the spin-flow necking operation, such that necking is initiated substantially adjacent to the end of the inwardly angled portion formed by the last die-necking operation. In this manner, in addition to taking advantage of the plug-diameter uniformity benefits of die-necking, the inward necking achieved during spin-flow necking can be additively combined to that realized by die-necking, thereby reducing end-piece metal requirements.

DETAILED DESCRIPTION

Figure 1A:
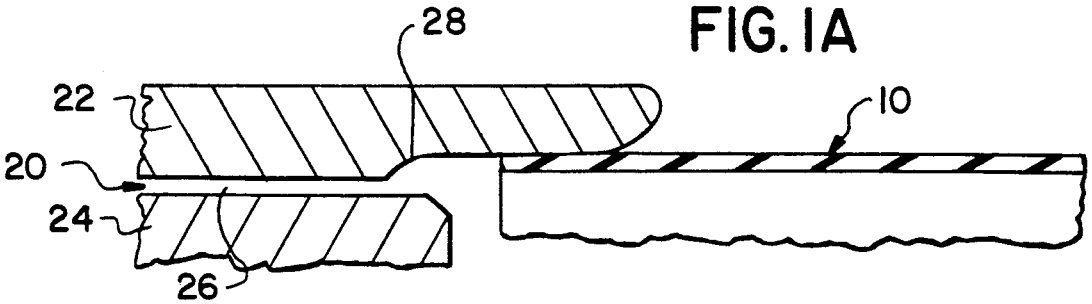
FIGS. 1A-1C are enlarged fragmentary sectional views of progressive stages in a die-necking operation comprising one embodiment of the present invention.
Figure 1B:
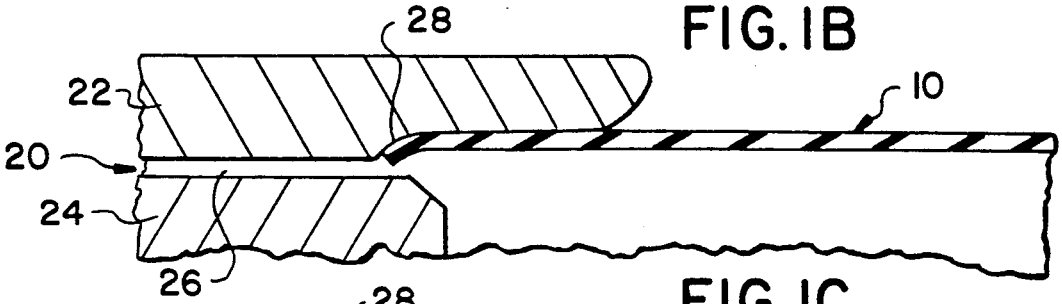
Figure 1C:
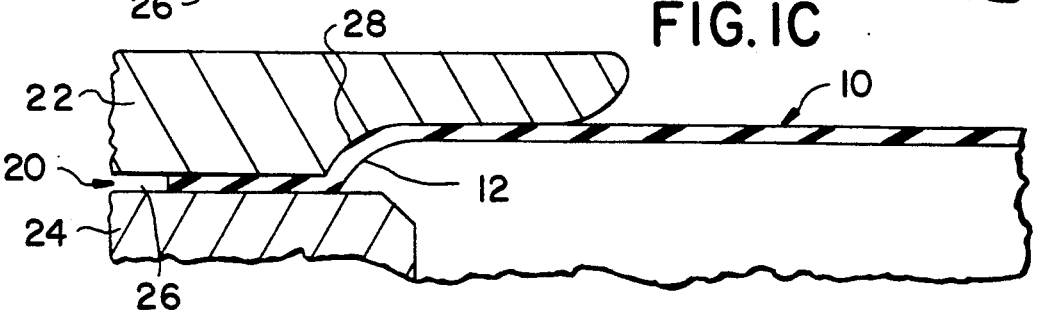

In one embodiment of the present invention, the diameter of the open end of a container body 10 is reduced to a first necked diameter in the die-necking operation shown per FIGS. 1A-1C, and further reduced to a second necked diameter in the spin-flow necking operation shown per FIGS. 2A-2D. At a first necked diameter as shown in FIGS. 1A-1C, the open end of container body 10 is first axially aligned with a conventional die set 20 comprising an external die member 22 and cylindrical internal pilot 24. The container body 10 is then axially driven towards die set 20 to force the open end of the container body 10 into the space 26 between the external die member 22 and pilot 24. More particularly, the open end of container body 10 contacts angled forming surface 28 of the external die member 22 and is guided into space 26, thereby forming an inwardly angled portion 12 in the container body 10 and reducing the diameter of the open end thereof to a first necked diameter.

As shown in FIGS. 2A-2D, the container body 10 is then spin-flow necked to further reduce the open end 12 thereof to a second necked diameter. U.S. Pat. Nos. 4,563,887 and 4,781,047, directed to spin-flow forming, are hereby incorporated by reference.

More particularly, first and second support members 30 and 40 are positioned inside the open end of container body 10, and external roller 50 is positioned in opposing relation to the first support member 30 with container body 10 therebetween. First support member 30 is freely rotatable and axially fixed, while second support member 40 is mounted for driven rotation with container body 10 and is axially spring-loaded towards the first support member 30 to allow for forced and controlled axial movement away from the first support member 30, as will be further described below with reference to FIGS. 2A-2D. External roller 50 is freely rotatable and can be driven radially inward. Further, external roller 50 is similarly axially spring-loaded to allow for forced and controlled axial movement relative to first support member 30, as shown in FIGS. 2A-2D.

Figure 2A:
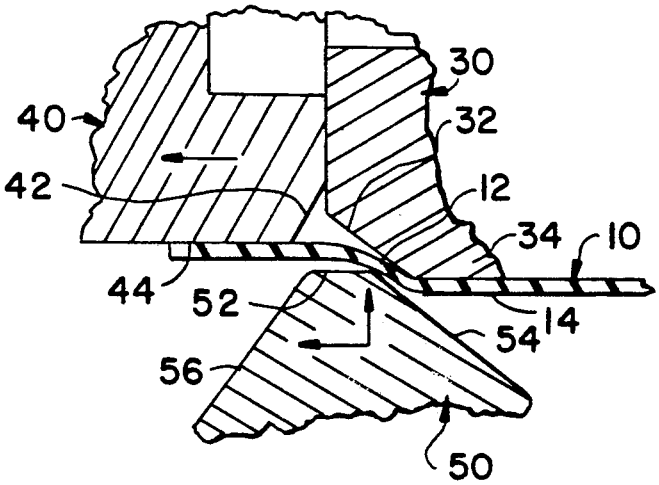
FIGS. 2A-2D are enlarged fragmentary sectional views of progressive stages in a spin-flow necking operation comprising one embodiment of the present invention.
Figure 2B:
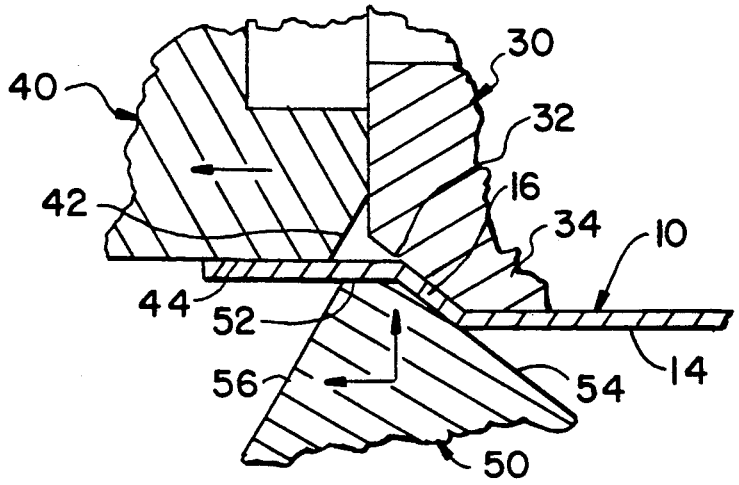
Figure 2C:
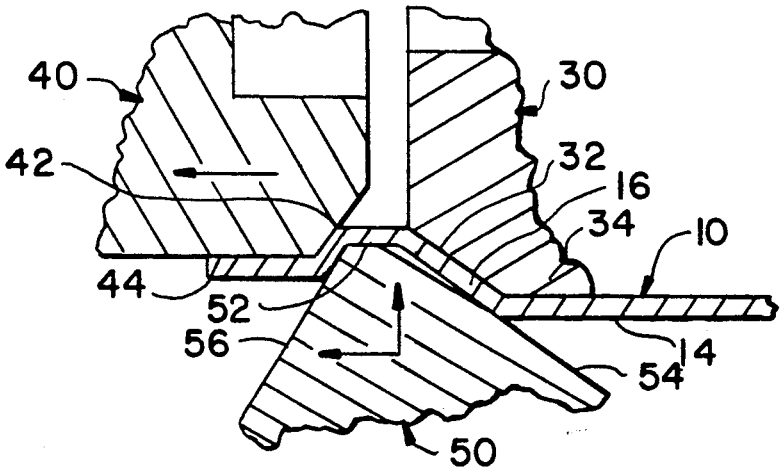
Figure 2D:
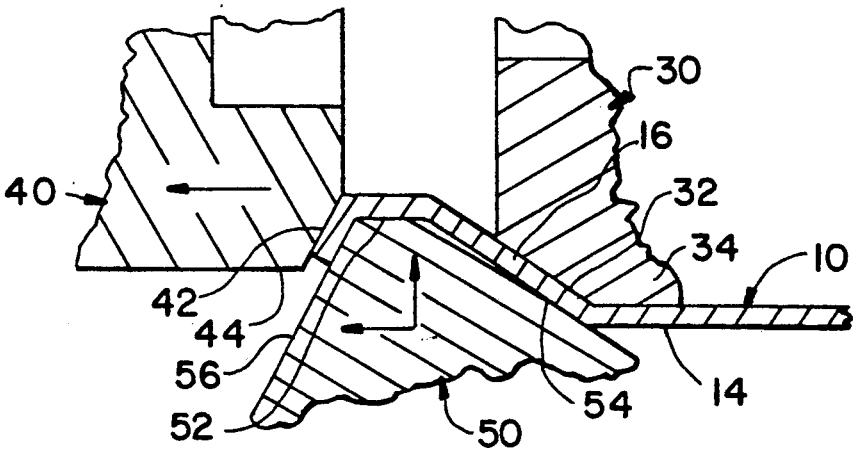

In operation, external member 50 is driven radially inward and nose 52 and a first angled surface 54 thereof contact container body 10 (FIG. 2A) Upon contact, first angled surface 54 begins to cam against complimentarily angled surface 32 of first support member 30 (FIG. 2B). Such camming action forces external roller 50 to move axially against the spring-loading applied thereto as it is driven radially inward. As such camming action progresses (FIG. 2C), a second angled face 56 of external roller 50 interfaces with complimentarily angled face 42 of the second support member 40. Such interface forces second support 40 to move axially against the spring-loading applied thereto as external roller 50 progresses radially and axially.

In one aspect of the embodiment shown FIGS. 1A-1C and 2A-2D, the diameter of the cylindrical peripheral portion 44 of the second support member 40, adjacent to angled face 42 thereof, is substantially equal to the first necked diameter, or plug diameter, of the open end of container body 10 achieved by the die-necking operation shown in FIGS. 1A-1C. As such, the second support member 40 can be readily and consistently positioned within a container body !0, in a substantially circumferentially flush manner for the spin-flow necking operation. Further, the peripheral portion 34 of the first support member 30, adjacent to the angled face 32 thereof, is configured and positioned to be substantially flush during spin-necking with a portion 14 of the container body 10 adjacent to that portion 16 of container body 10 being spin-necked.

In another aspect of the embodiment shown in FIGS. 1A-1C and 2A-2D, the inner-forming surface 28 of external necking die 22 and the angled face 32 of first support member 30 are selected so that the inwardly angled portion 12 of container body 10 resulting from the die necking operation can be disposed substantially flush with the angled face 32 of the first support member 30 for control enhancement during the spin-flow necking operation as shown in FIGS. 2A-2D. For example, in one application of the present invention, inner forming surface 28 is disposed at an angle of about 35° relative to the center axis of container body 10 during the die-necking operation. As a result, inwardly angled portion 12 of container body 10 will be disposed at an angle of about 33° relative to the center axis of container body 10 after post die-necking spring-back. In turn, angled surface 32 of first support member 30 is disposed at an angle of about 33° relative to the center axis of container body 10 during the spin-flow necking operation so that at least a portion of the inwardly angled portion 12 of container body 10 is positioned substantially flush thereagainst during spin-flow necking.

Further, it should be noted in FIGS. 2A-2D that since first angled face 54 of external roller 50 and angled face 32 of first support member 30 are complimentary, spin-flow necking of the container body 10 can be smoothly and controllably initiated as shown in FIG. 2A. That is, contact between nose 52 and container body 10 occurs substantially simultaneously with contact between first angled surface 54 and container body 10 and camming of first angled surface 54 against angled surface 32 of first support member 30, thereby fully realizing the beneficial control over container body 10 that is capable with spin-flow necking.

In yet another aspect of the described embodiment, it should be noted that external roller 50 is positioned so that the most inward portion of first angled face 54 (i.e., the portion adjacent to nose 52) first contacts container body 10 substantially adjacent to the end of inwardly angled portion 12 of container body 10 formed by the die-necking operation, thereby resulting in maximum additive necking during the die-necking and spin-flow necking processes.

The described embodiment of the present invention has been, for example, successfully applied to reduce the open end plug diameter of a "211" metal beverage container (i.e., one having a beginning plug diameter of approximately 2.600 inches) to a "204" plug diameter (i.e., a plug diameter of approximately 2.160 inches). In such application, the die-necking step shown in FIGS. 1A-1C reduced the plug diameter from "211" to a first necked diameter of "209" (i.e., approximately 2.463 inches), and the spin-flow necking step shown in FIGS. 2A-2D further reduced the plug diameter from the first necked diameter of "209" to "204". In this application, reduced variability in the spin-necked containers was realized, and spin-flow necking operational problems were reduced. As a result, operating windows have been increased, production capabilities enhanced, and end-piece metal requirements reduced.

It should be appreciated that in other embodiments of the present invention, external roller 50 could be positioned for spin-flow necking such that first angled face 54 thereof re-necks all or a portion of the inwardly angled portion 12 of container body 10 resulting from the die-necking operation. Such re-working may be desirable, for example, to define or refine the angled transition portions between necked and unworked regions of container body 10.

Further, it should be appreciated that in other embodiments of the present invention, multiple die-necking operations may be conducted prior to the spin-flow necking step. For example, multiple die-necking operations can be employed to yield an extended and substantially smooth inwardly angled portion 12, as is known in the art. In such an embodiment, the present invention has been employed to reduce the open end of a "211" metal beverage container to a "202" plug diameter (i.e., a plug diameter of approximately 2.060 inches) with two die-necking operations conducted prior to the spin-flow necking step. In such embodiment, the resultant container bodies displayed a single, smooth, inwardly angled transition portion 12 between the unnecked and necked portions, as is desirable.

In applications where successive stair-stepped die-necked regions are defined, it may be desirable to configure first support member 30 in a complimentarily inwardly progressive stair-step fashion, so that the first support member can be disposed substantially flush with the die-necked container during spin-flow necking operations.

The foregoing description of the invention has been presented for purposes of illustration and description. Further, the description is not intended to limit the invention to the form disclosed herein. Consequently, variations and modifications commensurate with the above teachings, and the skill or knowledge in the relevant art are within the scope of the present invention. The preferred embodiment described hereinabove is further intended to explain the best mode known of practicing the invention and to enable others skilled in the art to utilize the invention in various embodiments and with various modifications required by their particular applications or uses of the invention. It is intended that the appended claims be construed to include alternate embodiments to the extent permitted by the prior art.

What is claimed is:

1. A method of necking an open end of each of a plurality of cylindrical metal container bodies produced by a plurality of container body forming apparatus, wherein each said open end defined a plug, and wherein said plugs of said plurality of container bodies each have a first plug diameter within a first variance, comprising:

performing at least one die-necking operation on said open end of each metal container body to reduce each said plug to a first necked diameter which is less than said first plug diameter, said first necked diameter of each said plug of said plurality of container bodies being within a second variance which is less than said first variance, said die-necking operation for each said container body comprising:

axially aligning said open end of said container body with a die set having an external necking die and opposing internal pilot; and forcing said open end of said container body between said external necking die and opposing internal pilot to reduce said plug of said container body to said first necked diameter, wherein after said die necking operation each said container body has sidewall, angled, and end portions, said sidewall portion having a diameter substantially equal to said first plug diameter and being substantially parallel to a central axis of said container body, said angled portion being substantially adjacent to said sidewall portion and extending inwardly toward said open end of said container body and said central axis, said end portion being positioned between said open end and said angled portion, said end portion extending substantially parallel to said central axis to define said plug and having a diameter substantially equal to said first necked diameter after said die-necking operation; and performing a spin-flow necking operation on said open end of each said metal container body to reduce said plug to a second necked diameter which is less than said first necked diameter, wherein said spin-flow necking operation for each said container body comprising:

positioning first and second rotatable support members inside said open end, said first support having at least a first cylindrical surface for substantially flushly engaging and supporting said sidewall surface of said container body and an adjacent angled surface for substantially flushly engaging at least a portion of said angled portion of said container body formed by said die-necking operation, said second support having a cylindrical surface for substantially flushly engaging and supporting an inner circumferential portion of said end portion of said container body formed by said die-necking operation;

radially advancing an external roller, having an angled surface in opposing relation to at least a portion of said angled surface of said first support, inwardly toward said central axis, wherein at least a portion of said angled portion of said container body formed by said die-necking operation is substantially flushly positioned between said angled surfaces of said external roller and said first support; and continuing to radially advance said external roller inward toward said central axis, wherein said angled surface of said external roller cams radially and axially against said angled surface of said first support member towards said open end of said container body to reduce the diameter of said end portion and said plug to said second necked diameter.

2. The necking method of claim 1, wherein said first support member is axially fixed and said external roller is spring-loaded to controllably oppose said axial movement of said external roller towards said open end of said container body.

3. The necking method of claim 1, wherein during said continuing to radially advance step of said spin-flow necking operation an angled second surface of said external roller interfaces with a complementarily angled surface of said second support member to force said second support member towards said open end of said container body.

4. The necking method of claim 3, wherein said second support member is spring-loaded to controllably oppose said movement thereof towards said open end of said container body.

5. The necking method of claim 3, wherein a peripheral portion of said second support member adjacent to said angled surface thereof is of an external diameter substantially equal to said first necked diameter.

6. The method of claim 1, wherein the last of said at least one die-necking operation forms at least a part of said angled portion in said container body, said part of said angled portion being disposed substantially flush with at least a portion of said first support member throughout said spin-flow necking operation.

7. The method of claim 1, wherein an inner forming surface of said external necking die and said angled surface of said first support member are angled so that during said spin-flow necking operation at least a portion of said angled surface of said first support member is disposed substantially flush with at least a portion of said angled portion of said metal container body formed at least in part during the last of said at least one die-necking operation.

8. The method of claim 1, wherein the last of said at least one die-necking operation forms at least a part of said angled portion in said metal container body, and wherein said external roller and said first support member are positioned relative to said angled portion said metal container body at the outset of said spin-flow necking operation so that said camming of said angled surface of said external roller against said angled surface of said first support member is initiated substantially adjacent to the most inward extent of said angled portion of said metal container body.

9. The method of claim 1, wherein a plurality of die-necking operations are performed.

10. The method of claim 9, wherein said plurality of die-necking operations form said angled portion in said metal container body, said angled portion being substantially a conical surface.

* * * * *